US005463284A

United States Patent [19]

Mattas

[11] Patent Number: 5,463,284

[45] Date of Patent: Oct. 31, 1995

[54] LAMP BALLAST CIRCUIT CHARACTERIZED BY A SINGLE RESONANT FREQUENCY SUBSTANTIALLY GREATER THAN THE FUNDAMENTAL FREQUENCY OF THE INVERTER OUTPUT SIGNAL

[75] Inventor: Charles B. Mattas, Glenview, Ill.

[73] Assignee: North American Philips Corporation, New York, N.Y.

[21] Appl. No.: 329,700

[22] Filed: Oct. 26, 1994

Related U.S. Application Data

[63] Continuation of Ser. No. 932,840, Aug. 20, 1992, abandoned.

[51] Int. Cl.[6] ..... H05B 37/00

[52] U.S. Cl. ..... 315/240; 315/244; 315/289; 315/227 R; 315/DIG. 5

[58] Field of Search ..... 315/244, 209, 315/240, 289, 291, DIG. 2, DIG. 5, DIG. 7, 2227, 241 R

[56] References Cited

U.S. PATENT DOCUMENTS

| | | | |
|---|---|---|---|
| 4,060,751 | 11/1976 | Anderson | 315/209 R |
| 4,060,752 | 11/1977 | Walker | 315/244 |
| 4,441,055 | 4/1984 | Balchjunas | 315/288 |
| 4,641,061 | 2/1987 | Munson | 315/210 |
| 5,013,974 | 5/1991 | Nilssen | 315/244 |
| 5,214,356 | 5/1993 | Nilssen | 315/224 |

*Primary Examiner*—Robert J. Pascal
*Assistant Examiner*—Reginald A. Ratliff
*Attorney, Agent, or Firm*—Edward Blocker

[57] ABSTRACT

A lamp driving circuit having a series inductor and capacitor (L-C) in which the lamp load is connected in parallel with the capacitor. During pre-ignition of the lamp load, the driving signal supplied by a half-bridge oscillator includes a fundamental frequency and a third harmonic of the fundamental frequency. The resonant frequency of the series connected L-C circuit is at least $\sqrt{5}$ times greater than the fundamental frequency but less than the third harmonic of the driving signal.

27 Claims, 5 Drawing Sheets

FIG. 1
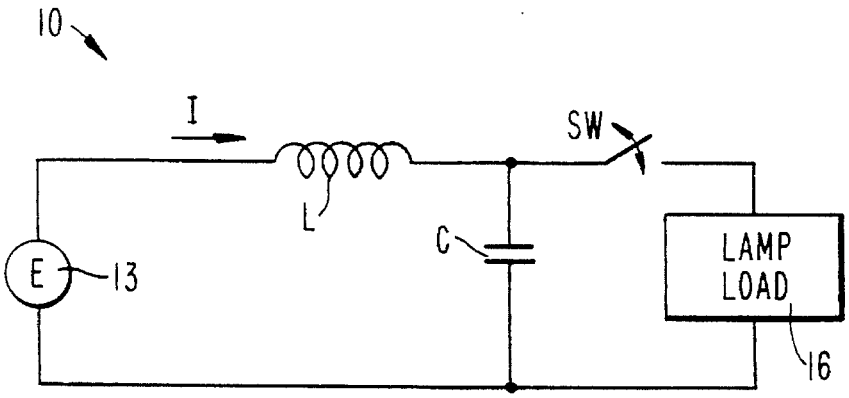
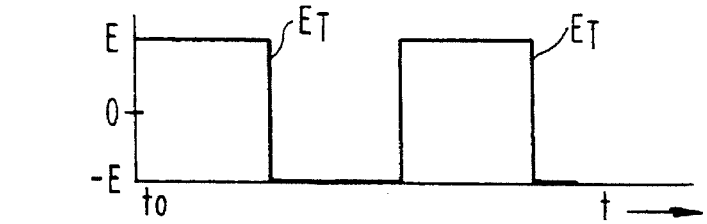
FIG. 2(a)
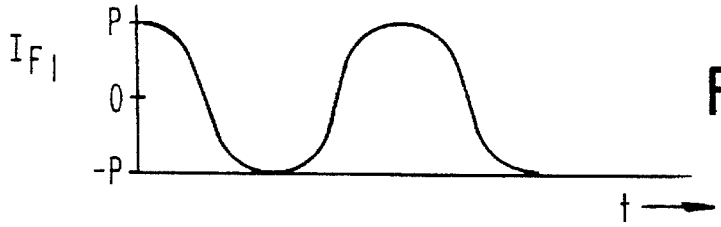
FIG. 2(b)
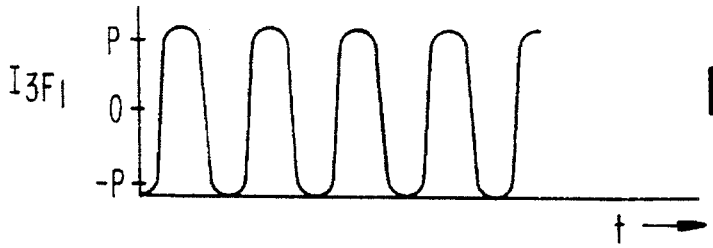
FIG. 2(c)

FIG. 6

| PART | PART DESCRIPTION |
|---|---|
| $R_{1,21}$ | 392K, 1%, 1/4 W |
| $R_2$ | 2.37K, 1%, 1/8 W |
| $R_{3,29}$ | 100K, 5%, 1/2 W |
| $R_4$ | 10, 5%, 1/8 W |
| $R_5$ | 1.0, 5%, 1/4 W |
| $R_{6,7}$ | 470K, 5%, 1/4 W |
| $R_{8,24}$ | 953K, 1%, 1/4 W |
| $R_9$ | 10.0K, 1%, 1/8 W |
| $R_{10,26}$ | 200K, 5%, 1/4 W |
| $R_{11,16}$ | 51, 5%, 1/8 W |
| $R_{12}$ | 10K, 5%, 1/8 W |
| $R_{13,17}$ | 1.0K, 5%, 1/8 W |
| $R_{14,15}$ | 620, 5%, 1/4 W |
| $R_{20}$ | 25.5K, 1%, 1/8 W |
| $R_{22}$ | 22.1K, 1%, 1/8 W |
| $R_{23}$ | 300, 5%, 1/8 W |
| $R_{30}$ | 200K, 5%, 1/8 W |
| $R_{31}$ | 10K, 5%, 1/8 W |
| $R_{34}$ | 10K, 5%, 1/4 W |
| $R_{35}$ | 2.4K, 5%, 1/8 W |
| $C_1$ | 47NF, 20%, CLASS X |
| $C_2$ | 3.3NF, 20%, 3KVDC |
| $C_3$ | 47NF, 20%, CLASS X |
| $C_4$ | 0.27UF, 10%, 600VDC |
| $C_{5,6}$ | 27UF, 20%, 280VDC |
| $C_{7,13}$ | 47NF, 20%, 50VDC |
| $C_{10}$ | 1.2NF, 5%, 2KVDC |
| $C_{11}$ | 0.47UF, 10%, 250VDC |
| $C_{12}$ | 470PF, 20% 3KVDC |
| $C_{14}$ | 100UF, 20%, 35VDC |
| $C_{15}$ | 1.0NF, 20%, 50VDC |
| $C_{16}$ | 0.33UF, 10%, 50 VDC |
| $C_{17}$ | 1.0NF, 5%, 50 VDC, NPO |
| $C_{18}$ | 10NF, 20%, 50VDC |
| $C_{21}$ | 4.7UF, 20%, 25VDC |
| $C_{23}$ | 220PF, 20%, 1KVDC |

| PART | PART DESCRIPTION |
|---|---|
| $L_7$ | 4.3 MH |
| $L_1$ | 800UH IGNITOR CHOKE |
| $L_2$ | COM MODE CHOKE |
| $L_3$ | 22MM CHOKE, 2 WINDINGS |
| $L_{4-6}$ | 12UH CHOKE |
| $T_1$ | XFORMER, POT CORE |
| $D_{1-4}$ | 1A, 800 V |
| $D_5$ | 1.3A, 600V, FAST REC. |
| $D_6$ | 1.3A, 600V, FAST REC. |
| $D_7$ | 0.2A, 75V |
| $D_9$ | 0.2A, 75V |
| $D_{10}$ | 0.2A, 75V |
| $D_{11}$ | 12V, 0.5W |
| $D_{13-17}$ | 0.2A, 75V |
| $Q_1$ | 3.6A, 600V |
| $Q_2$ | 0.25A, 600V |
| $Q_{3,4}$ | 0.2A, 40V, NPN |
| $Q_5$ | 0.2A, 40V, PNP |
| $Q_{6,7}$ | 3.6A, 600V |
| $IC_1$ | MC3326ID, S08 |
| $IC_2$ | 555, CMOS, S08 |
| $IC_3$ | TL431CLP, T092 |
| $F_1$ | 3A, 300V |

LAMP BALLAST CIRCUIT CHARACTERIZED BY A SINGLE RESONANT FREQUENCY SUBSTANTIALLY GREATER THAN THE FUNDAMENTAL FREQUENCY OF THE INVERTER OUTPUT SIGNAL

This is a continuation of application Ser. No. 07/932,840, filed Aug. 20, 1992, now abandoned.

BACKGROUND OF THE INVENTION

This invention relates generally to a lamp ballast output circuit, and more particularly to a lamp ballast output circuit having a series inductor-capacitor (L-C) resonant circuit operating substantially below the resonant frequency during pre-ignition of the lamp load.

In a conventional series connected L-C circuit, the lamp load is connected across the capacitor. During pre-ignition of the lamp load, the series L-C circuit operates substantially at its resonant frequency. That is, the driving signal applied to the series L-C circuit is at or near the resonant frequency of the series L-C circuit. In this way a sufficiently high pre-ignition voltage is applied across the lamp load for ignition of the latter.

The lamp load, typically of a fluorescent type, following ignition, achieves a substantially steady-state sinusoidal current flow therethrough by reducing the driving signal frequency well below the resonant frequency of the series L-C circuit. In determining when to switch from the resonant frequency to a different steady-state operating frequency, feedback circuitry is often required for sensing lamp ignition.

A sufficiently high voltage during pre-ignition of the lamp and sinusoidal lamp current following ignition (i.e. steady state operation), is commonly provided by a half-bridge inverter. The half-bridge inverter includes switching to control the frequency of the driving signal applied to the series L-C circuit. Control circuitry, responsive to the feedback circuitry, is required for controlling the speed at which the switching takes place.

Conventional lamp ballast output circuits, as described above, suffer from several drawbacks. For example, conventional lamp ballast output circuits require generating two different frequencies, that is, the resonant frequency during pre-ignition of the lamp load and a different steady-state operating frequency. Such circuits also require sensing circuitry to determine when to switch from the resonant frequency to the steady state operating frequency.

It is particularly undesirable to operate at or near the resonant frequency of the series L-C circuit before lamp ignition inasmuch as unsafe, high voltages and current levels can occur (i.e. above the maximum ratings of one or more ballast circuit components). By operating below resonance during pre-ignition of the lamp load, capacitive switching of the half-bridge inverter can easily occur producing high switching losses. Additional circuitry is therefore required to prevent the half-bridge inverter from operating below the series L-C circuit resonant frequency during pre-ignition of the lamp load.

The inductance of inductor L is normally determined based on the desired lamp current during steady state conditions. The capacitance of capacitor C is thereafter chosen so as to provide a resonant condition (typically between 20–50 kHz for a fluorescent lamp). Generally, the capacitance of capacitor C is between about 5 to 10 nanofarads leading (with the additional high voltage capability) to a relatively costly capacitor requiring a relatively large space on a printed circuit board.

Accordingly, it is desirable to provide a lamp ballast output circuit having a safe open circuit (i.e., pre-ignition) voltage and current level, with relatively low switching losses. The improved lamp ballast output circuit should not need a driving signal at more than one frequency, this frequency being well below resonance of the series L-C circuit. It is also desirable that the improved lamp ballast output circuit permit use of a relatively less expensive, smaller capacitor in order to lower the lamp ballast manufacturing cost and to reduce the reactive current flowing through the capacitor after lamp ignition thus lowering circuit power loss.

SUMMARY OF THE INVENTION

Generally speaking, in accordance the invention, a ballast circuit for generating a driving signal during pre-ignition of a lamp includes a generating circuit for applying a generated signal to a serially connected inductor-capacitor (L-C) circuit having at least a fundamental frequency. The output signal is provided across the capacitor. The L-C circuit is characterized by a resonant frequency which is at least $\sqrt{5}$ times greater than the fundamental driving frequency but less than three (3) times the fundamental driving frequency.

By operating in this region during pre-ignition, safe voltage and current levels can be maintained. A single drive frequency results in safe non-resonant operation before lamp ignition as well as correct lamp current after ignition. Feedback circuitry for sensing ignition of the lamp load for switching to a different steady-state lamp operating frequency need not be provided. By eliminating the need to operate at the resonant frequency of the series connected L-C circuit during pre-ignition of the lamp load, the value and resulting size of the capacitor can be far smaller than normally used in a conventional series connected L-C circuit.

In accordance with a feature of the invention, the generated signal is a train of square waves generated preferably by a half-bridge or full bridge inverter. In yet another feature of the invention, the resonant frequency of the series connected L-C circuit is less than the third harmonic frequency of the generated square wave drive thereby avoiding unsafe third harmonic voltages and current levels during pre-ignition of the lamp load. Substantially the same generated signal frequency is used during pre-ignition and steady-state operation of the lamp load.

In accordance with another aspect of the invention, a method for generating a driving signal to drive a lamp load during at least pre-ignition of a lamp load includes producing a generated signal having at least a fundamental frequency. The method further includes applying the generated signal to a series connected inductor and capacitor. The voltage developed across the capacitor serves as the lamp igniting source. The inductor and capacitor are characterized by a resonant frequency which is at least $\sqrt{5}$ times greater than the fundamental frequency of the generated signal.

It is a feature of this aspect of the invention that the generated signal be a train of square waves which is preferably produced from a half-bridge or full bridge inverter. The method also includes selecting a capacitor whereby the resonant frequency is less than the third harmonic of the fundamental frequency.

The lamp load following ignition enters into a steady-state mode of operation in which current therethrough is maintained at a substantially constant level. During the steady-state mode, the method also includes continuing to produce substantially the same generated signal produced during pre-ignition of the lamp load.

Accordingly, it is an object invention to provide an improved ballast circuit in which the unloaded, open circuit voltage and current levels are within the operating range of the ballast circuit components.

It is another object of the invention to provide an improved ballast circuit in which the same inverter driving signal can be used during pre-ignition and steady-state operation of the lamp load.

It is a further object of the invention to provide an improved ballast circuit in which less costly components can be used to lower the manufacturing cost of the ballast.

It is still another object of the invention to provide an improved ballast circuit which eliminates the need for feedback circuitry for sensing lamp ignition for changing the inverter frequency.

It is still a further object of the invention to provide an improved ballast circuit in which the inverter driving signal frequency is substantially less than the resonant frequency of a series connected L-C output circuit during pre-ignition of the lamp load.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all is exemplified in the following detailed disclosure and the scope of the invention will be indicated in the claims.

BRIEF DESCRIPTION OF DRAWINGS

For a fuller understanding of the invention, reference is had to the following description taken in connection with the accompanying drawings, in which:

FIG. 1 is a circuit diagram of a ballast output circuit in accordance with the present invention;

FIGS. 2(*a*), 2(*b*) and 2(*c*) are timing diagrams of a half-bridge inverter output voltage, output current at its fundamental frequency and output current at its third harmonic, respectively;

FIG. 6 is a tabular listing and description of the ballast circuit components of FIG. 5.

DETAILED DESCRIPTION OF THE PREFERRED EMBODIMENT

Figure 3:
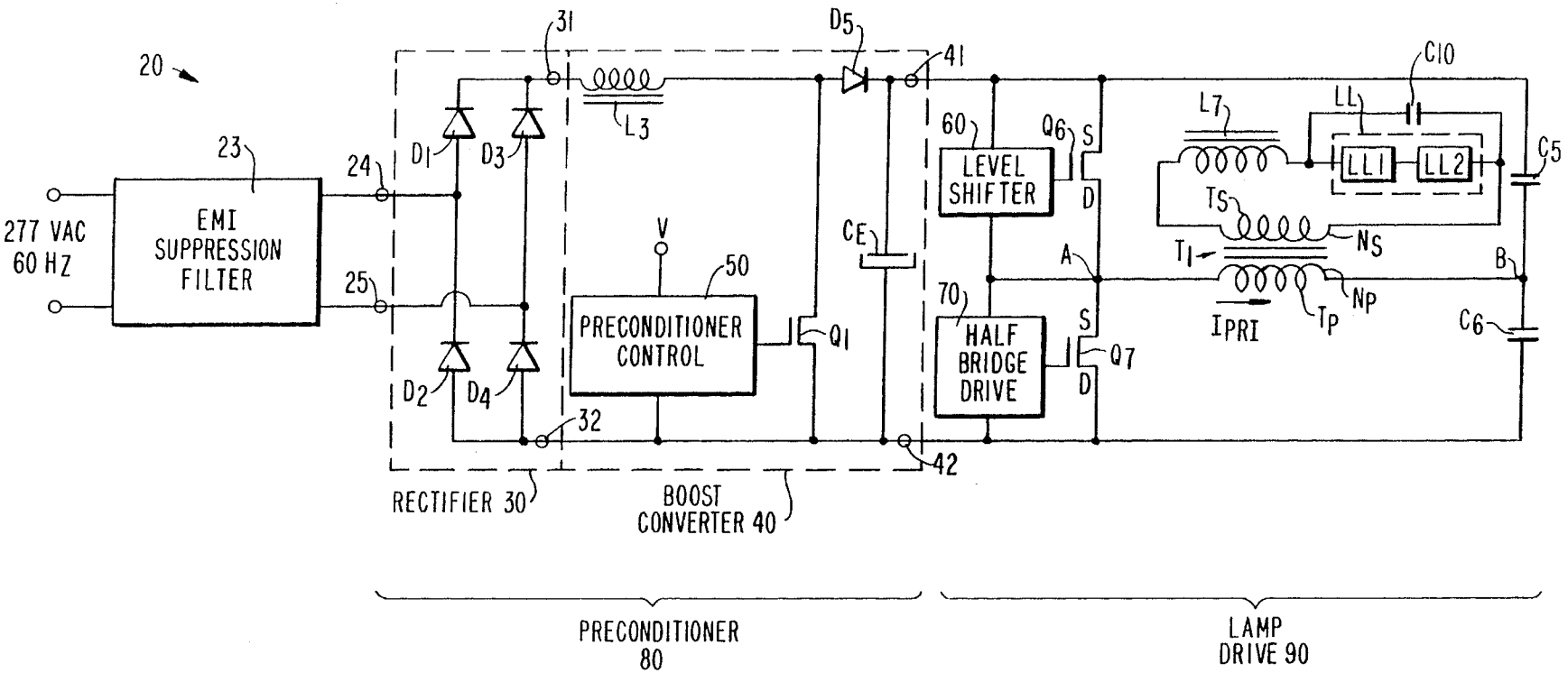
FIG. 3 is a schematic diagram of a ballast circuit in accordance with the invention.
Figure 4A:
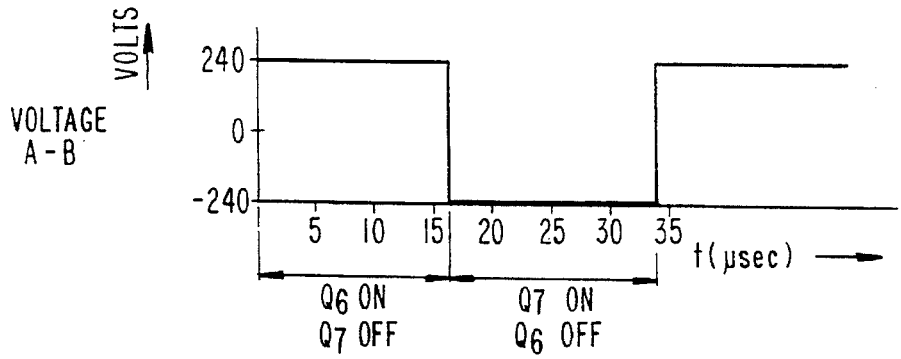
FIGS. 4(*a*), 4(*b*), 4(*c*) and 4(*d*) are timing diagrams of signals produced within the ballast circuit of FIG. 3 during pre-ignition and steady-state operation of the lamp load.
Figure 4B:
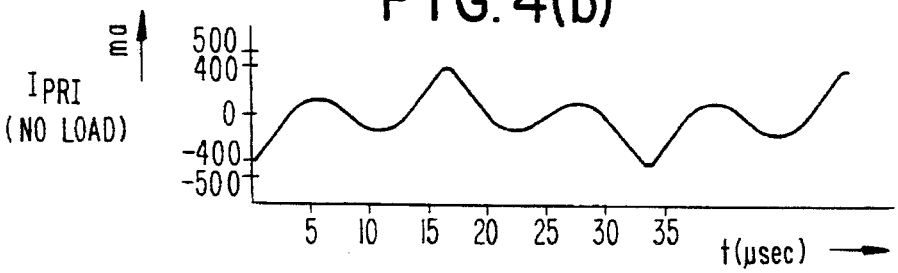
Figure 4C:
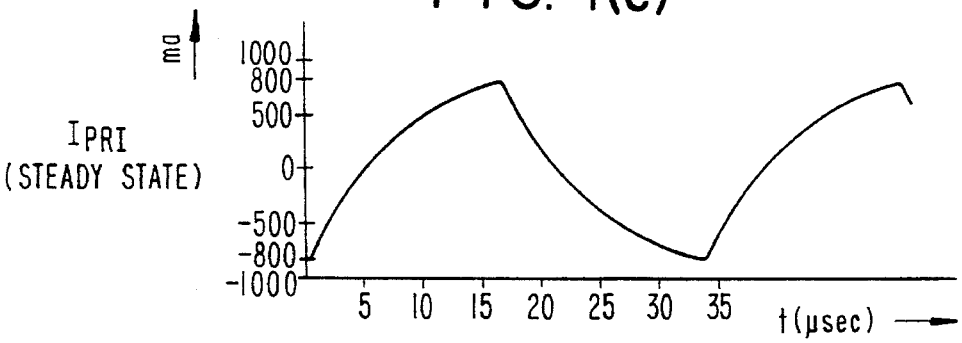
Figure 4D:
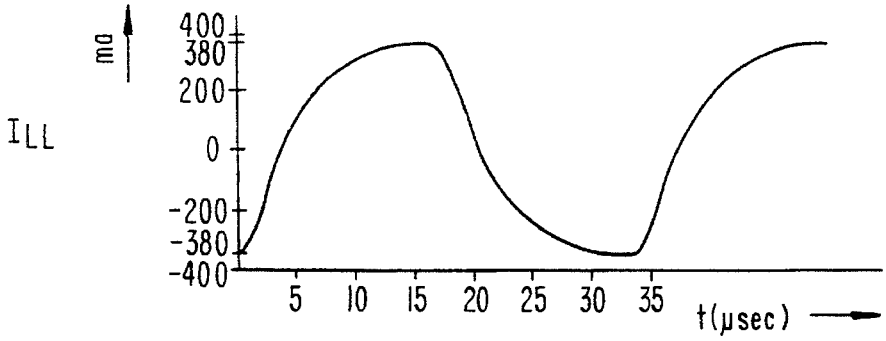

The figures shown herein illustrate a preferred embodiment of the invention. Those elements/components shown in more than one figure of the drawings have been identified by like reference numerals/letters and are of similar construction and operation.

Referring now to FIGS. 1, 2(*a*), 2(*b*) and 2(*c*), a ballast output circuit 10 includes an inductor L and a capacitor C serially connected across the output of a square wave generator 13. Square wave generator 13 is preferably, but not limited to, a half-bridge inverter generating a voltage±E (i.e. the inverter output voltage). A lamp load 16 is connected across capacitor C through a switch SW. A current I flowing through inductor L includes a fundamental frequency component $I_{f1}$ and a third harmonic component of the fundamental frequency $I_{3f1}$. Other currents at higher odd harmonics are present but are significantly smaller.

Square wave voltage 13 produces a sinusoidal wave at a fundamental frequency $f_1$ and odd harmonics of the fundamental frequency including a sinusoidal wave at a third harmonic $3f_1$. The amplitude of third harmonic component $f_1$ of voltage E is one third the amplitude of fundamental frequency component $f_1$ of voltage E.

To achieve low switching losses within square wave generator 13 during pre-ignition of lamp load 16 (generally at trailing edges $E_T$ of voltage E), current I is preferably inductive (i.e., current lagging drive voltage) rather than capacitive (i.e. current leading drive voltage) during the voltage transitions of voltage E. Accordingly, the sum of fundamental frequency current component $I_{f1}$ and third harmonic-current component $I_{3f1}$ is inductive wherein $I_{f1}$ and $I_{3f1}$ are the capacitive and inductive components of I, respectively. To achieve an overall inductive current I, an impedance Z of circuit 10 as viewed from square wave generator 13 requires that the inductive impedance at the third harmonic $Z_{3f1}$ be less than one third the capacitive impedance at the fundamental frequency $Z_{f1}$. In other words, third harmonic component current $I_{3f1}$ is greater than fundamental frequency component If1. This relationship is illustrated in FIGS. 2(*b*) and 2(*c*) wherein an amplitude P represents the peak value of fundamental frequency current component $I_{f1}$ but is less than the peak value of third harmonic current component $I_{3f1}$. In this way the sum of $I_{f1}$ and $I_{3f1}$ remains inductive at the voltage transitions of voltage E.

Lamp load 16 prior to ignition (i.e. during pre-ignition) appears as an open circuit. This open circuit condition is represented by switch SW in an open state (turned OFF). Following ignition, lamp load 16 is in its steady-state mode of operation and is represented by switch SW being turned ON such that lamp load 16 is connected in parallel with capacitor C.

Impedance $Z_{3f1}$, which must be less than one third impedance Zf1 during pre-ignition of lamp load 16, is therefore based on switch SW in its open state (i.e., turned OFF). This condition can be expressed as follows:

$$|Z_{f1}|>|3\ Z_{3f1}| \quad \text{(eq. 1)}$$

That is, $$|2\pi f_1\times L-1/(2\pi f_1\times C)|>3|6\pi f_1\times L-1\ /(6\pi f_1\times C)| \quad \text{(eq. 2)}$$

Since impedance Z is capacitive at fundamental frequency $f_1$ and inductive at the third harmonic $3f_1$, $$1/(2\pi f_1\times C)-2\pi f_1\times L>18\pi f_1\times L-\ 1/(2\pi f_1\times C)$$

That is, $$1/(2\pi f_1\times C)>5(2\pi f_1\times L) \quad \text{(eq. 3)}$$

Eq. 3 can be rewritten as follows:

$$1/\sqrt{LC}>\sqrt{5}2\pi f_1 \quad \text{(eq. 4)}$$

A resonant frequency $f_0$ of circuit 10 during pre-ignition (i.e., with switch SW open) can be defined as follows:

$$1/\sqrt{LC}=2\pi f_0 \quad \text{(eq. 5)}$$

Substituting the value of $1/\sqrt{LC}$ defined by eq. 4 for the value of $1\sqrt{LC}$ in eq. 5 results in $$2\pi f_0>\sqrt{5}2\pi f_1 \quad \text{(eq. 6)}$$

Accordingly, resonant frequency $f_0$ can be expressed a follows:ps $$f_0>\sqrt{5}f_1 \quad \text{(eq. 7)}$$

In other words, third harmonic inductive current component $I_{3f1}$ is greater than fundamental frequency capacitive current component $I_{f1}$ when resonant frequency $f_0$ is greater than $\sqrt{5}$ times the fundamental frequency of voltage E.

To ensure that unsafe voltages and currents present resonant frequency $f_0$ cannot occur, resonant frequency $f_0$ also should be less than third harmonic frequency $3f_1$ of voltage E. Therefore, the values of inductor L and capacitor C should be chosen such that:

$$\sqrt{5}f_1<f_0+21\ 3f_1 \quad \text{(eq. 8)}$$

By designing ballast circuit 10 such that resonant frequency $f_0$ is within the range of frequencies defined by eq 8, the unsafe voltages and currents which occur at resonant frequency $f_0$ during pre-ignition of lamp load 16 are avoided and total current delivered by square wave generator 13 remains inductive. There is no need to vary the frequency of voltage between resonant frequency $f_0$ during pre-ignition of lamp load 16 and a different frequency immediately thereafter as in conventional ballast circuitry. Feedback circuitry designed to sense ignition of lamp load 16 for determining when to vary the frequency of voltage E from resonant frequency $f_0$ to a different operating frequency can be eliminated. In accordance with the invention, a safer, simpler circuit is provided by maintaining resonant frequency $f_0$ within the boundaries define by eq. 8.

A ballast circuit 20 in accordance with the invention is shown in FIG. 3. An input voltage of 277 volts, 60 hertz is supplied to an electromagnetic interference (EMI) suppression filter 23. Filter 23 filters high frequency components inputted thereto lowering conducted and radiated EMI. The output of filter 20 provided at a pair of terminals 24 and 25 is supplied to a full wave rectifier 30 which includes diodes $D_1$, $D_2$, $D_3$ and $D_4$. The anode of diode $D_1$ and cathode of diode $D_2$ are connected to terminal 24. The anode of diode $D_3$ and cathode of diode $D_4$ are connected to terminal 25. The output of rectifier 30 (i.e. rectified A.C. signal) at a pair of output terminals 31 and 32 is supplied to a boost converter 40. The cathodes of diodes $D_1$ and $D_3$ are connected to terminal 31 The anodes of diodes D2 and D4 are connected to terminal 32.

Converter 40 boosts the magnitude of the rectified A.C. signal supplied by rectifier 30 and produces at a pair of output terminals 41 and 42 a regulated D.C. voltage supply. Boost converter 40 includes a choke L3, a diode $D_5$ the anode of which is connected to one end of choke L3. The other end of choke L3 is connected to output terminal 31 of rectifier 30. The output of boost converter 40 at output terminals 41, 42 is applied across an electrolytic capacitor $C_E$, one end of which is connected to the cathode of diode $D_5$. A transistor (switch) Q1 is connected to the junction between choke L1 and the anode of diode $D_5$. The other end of transistor Q1 is connected to the junction between the other end of capacitor $C_E$, output terminal 32 of rectifier 30 and output terminal 42.

A preconditioner control 50, which is powered by a D.C. supply voltage V, controls the switching duration and frequency of transistor Q1. Preconditioner control 50 is preferably, but not limited to, a Motorola MC33261 Power Factor Controller Integrated Circuit from Motorola Inc. of Phoenix, Ariz. Transistor Q1 is preferably a MOSFET, the gate of which is connected to preconditioner control 50. Rectifier 30 and boost converter 40, including preconditioner control 50, form a preconditioner 80 for ballast circuit 20. Output terminals 41 and 42 of boost converter 40 also serve as the output for preconditioner 80 across which a regulated D.C. voltage is produced.

A lamp drive 90, which is supplied with the regulated D.C. voltage outputted by preconditioner 80, includes a half bridge inverter controlled by a level shifter 60 and a half-bridge drive 70. The half bridge inverter includes a pair of transistors $Q_6$ and $Q_7$, which serve as switches, a pair of capacitors $C_5$ and $C_6$ and a transformer $T_1$. Half-bridge drive 70 produces a square wave driving signal to drive transistor $Q_7$ and has a 50-50 duty cycle. Level shifter 60 inverts the driving signal supplied to transistor $Q_7$ for driving transistor $Q_6$. The driving signals produced by level shifter 60 and half-bridge drive 70 are approximately 180° out of phase with each other so as to prevent conduction of transistors $Q_6$ and $Q_7$ at the same time, respectively.

A source S of transistor $Q_6$ and one end of level shifter 60 are connected to output terminal 41 of boost converter 40. A drain D of transistor $Q_6$ is connected to a terminal A. The other end of level shifter 60, one end of half-bridge drive 70 and a source S of transistor $Q_7$ are also are connected to terminal A. The other end of half-bridge drive 70 and a drain D of transistor $Q_7$ are connected to output terminal 42 of boost converter 40. Capacitor $C_5$ is connected at one end to output terminal 41. The other end of capacitor $C_5$ and one end of capacitor $C_6$ are connected to a terminal B. The other end of capacitor $C_6$ is connected to output terminal 42.

A primary winding $T_p$ of transformer $T_1$ is connected to terminals A and B. A secondary winding $T_S$ is connected at one end to an inductor $L_7$, the latter of which generally represents either the leakage inductance of transformer $T_1$ or a discrete choke. Connected to the other end of inductor $L_7$ is one end of a capacitor $C_{10}$ and one end of a lamp load LL. Lamp load LL can include any combination of lamps and is shown, but not limited to, the series combination of two fluorescent lamps $LL_1$ and $LL_2$. The other ends of capacitor $C_{10}$ and lamp load LL are connected to the other end of secondary winding $T_s$.

The turns ratio between primary winding $T_p$ and secondary winding $T_s$ of transformer $T_1$ is $N_p/N_s$. Transformer $T_1$ electrically isolates lamp load LL from the output voltage produced by preconditioner 80 and provides sufficient open circuit voltage during pre-ignition to ignite lamp load LL.

The inductance of inductor $L_7$ is based on the desired current flow through lamp load LL once the latter has ignited and is in its steady-state mode of operation. The DC voltage across each capacitor $C_5$ and capacitor $C_6$ is approximately half the output voltage of preconditioner 80.

The waveforms shown in FIGS. 4(*a*), 4(*b*), 4(*c*) and 4(*d*) produced by ballast circuit 20 are based on turns ratio $N_s/N_p$ of about 1.5, inductor $L_7$ of approximately 4.3 millihenries, capacitor $C_{10}$ of about 1.2 nanofarads and capacitors $C_3$ and $C_4$ of about 0.33 microfarads, nominally rated at 630 volts. Both lamp LL1 and lamp LL2 are 40 watt low pressure mercury vapor tubular fluorescent lamps. The fundamental frequency of the square wave produced by the half-bridge inverter is approximately 28 KHz. The resonant frequency of inductor $L_7$ and capacitor $C_{10}$ is approximately 70 KHz, that is, approximately 2.5 times fundamental frequency $f_1$. A more detailed description of the values and components of FIG. 3 is shown and described below with respect to FIGS. 5 and 6.

During pre-ignition of lamp load LL, the output of the half-bridge inverter, which is across terminals A–B, forms a substantially square wave voltage train. Inductor $L_7$ and capacitor $C_{10}$ form an L-C series connected circuit. During pre-ignition, lamp load LL appears as a substantially open circuit (i.e. no load condition) drawing substantially no power expect for filament heating (assuming lamps LL1 and LL2 are fluorescent lamps of, for example, the rapid-start type).

FIG. 4(*a*) illustrates a voltage VAB, that is, between terminals A and B. Voltage $V_{AB}$ is square wave voltage train which is applied across primary winding $T_p$ varying between approximately +240 volts and −240 volts during no load conditions. FIG. 4(*b*) illustrates current $I_{PRI}$ flowing through primary winding $T_p$ during no load conditions, that is, prior to ignition of lamp load LL and having a peak value of approximately ±400 milliamperes. Once lamp load LL is ignited and is in its steady-state operation, current $I_{IPR}$ flowing through primary winding $T_p$, as shown in FIG. 4(*c*), has a somewhat sinusoidal wave shape with a peak value of approximately ±800 milliamperes. Capacitor $C_{10}$ serves to smooth this somewhat sinusoidal current waveform resulting in a substantially sinusoidal lamp current $I_{LAMP}$ as shown in FIG. 4(*d*) having a peak value of approximately ±380 milliamperes.

Inductor $L_7$ serves as the lamp current ballasting element. Capacitor $C_{10}$, which is placed across lamp load LL, provides a more sinusoidal open circuit voltage and keeps total half bridge current inductive while also lowering higher harmonic content of current flowing through lamp load LL. Inductor $L_7$ and capacitor $C_{10}$ together form a series connected L-C output circuit. The value for capacitor $C_{10}$ is chosen such that safe open circuit operation is provided, that is, within the range of resonant frequencies defined by eq. 8. Accordingly, no additional circuits to protect lamp drive circuit 90 are required.

When ballast circuit 20 is first turned on, prior to the voltage being boosted by preconditioner 80, the input voltage of approximately 277 volts results in a SQUARE WAVE voltage of approximately 390 volts peak to peak being applied across primary winding $T_p$ of transformer $T_1$ which is stepped up to approximately 570 volts peak to peak across secondary winding $T_s$. During this time the lamp cathodes are heated. After approximately 0.5 seconds, preconditioner 80 turns ON resulting in a regulated D.C. voltage of approximately 480 volts across output terminals 41, 42 of boost converter 40 and a voltage approximately 700 volts peak to peak across secondary winding $T_s$, the latter of which is sufficient for igniting lamp load LL. Once lamp load LL is ignited (i.e. during steady-state lamp operation), the lamp voltage (i.e. voltage across lamp load LL) drops to approximately ±300 volts peak with the remainder of the secondary winding $T_S$ output voltage across inductor $L_7$. The number of and connections between the lamps within lamp load LL can be varied as desired with the value of inductor $L_7$ being chosen so as to provide the desired lamp current $I_{LAMP}$ during steady-state operation of lamp load LL.

Figure 5:
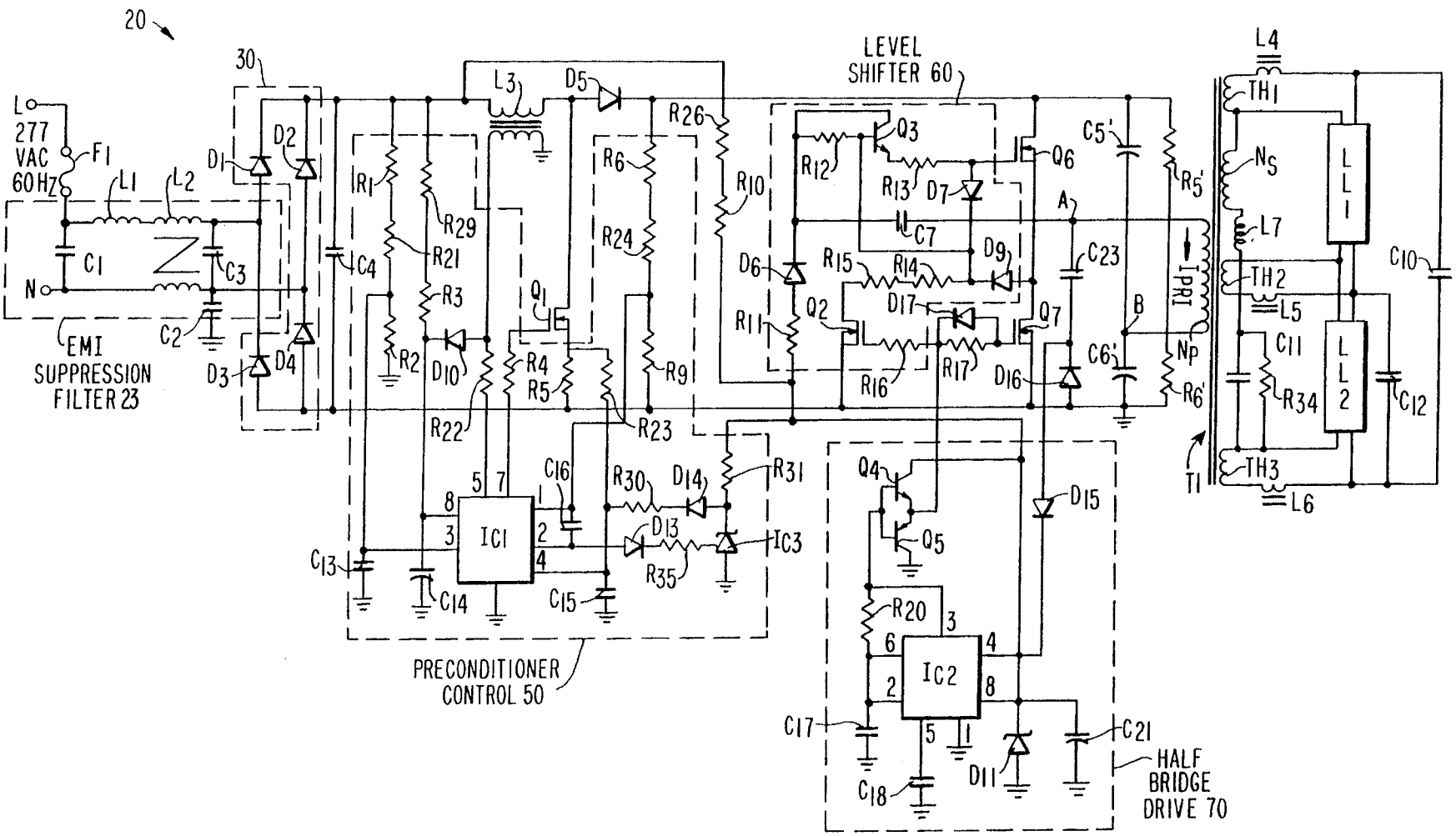
FIG. 5 is a more detailed schematic diagram of FIG. 3.

A more detailed schematic diagram of ballast circuit 20 including the construction of EMI suppression filter 23 preconditioner control 50, level shifter 60 and half-bridge drive 70 is shown in FIG. 5. The values for and description of the components shown in FIG. 5 are tabularly listed in FIG. 6.

Referring now to FIG. 5, EMI suppression filter 23 includes a fuse F1 connected to the line (L) side of the 277 voltage A.C. line, a capacitor C1 connected between fuse F1 and the neutral (N) side of the 277 volt A.C. line and two filters. The A.C. voltage ($V_{LN}$) of 277 volts between line and neutral is shown for exemplary purposes only and is not limited thereto. The first filter rejects normal mode signals. The second filter rejects common mode signals. These two filters include, in part, a normal mode inductor L1 and a ballast transformer L2 for common mode rejection. Across the line is a capacitor C3 which is used as part of a normal mode filter of inductor L1. A capacitor C2 connected from neutral to ground serves as a common mode capacitor and is part of the common mode rejection filter.

Rectifier 30 is constructed similar to and with the same elements as shown in FIG. 3. Preconditioner control 50 includes a preconditioner integrated circuit (IC) chip IC1 operating in an asynchronous mode (i.e. not in synchronism with the A.C. voltage ($V_{LN}$) inputted to ballast circuit 20). Chip IC1 has four control input signals.

The first control input signal flows into pin 3 of chip IC1 from the rectified AC line through a resistor divider network including thru resistors R1, R21, and R2 and a capacitor 13. This first control input signal represents the rectified AC voltage signal as an input to chip IC1.

The second control input signal flows into pin 5 of chip IC1, and represents the current flow of choke L3. This second control input signal is used to turn ON transistor Q1 when the current flow through choke L3 is about zero. Chip IC1, responsive to the second control input signal, produces a driving signal through a resistor R4 to turn ON transistor Q1.

The third control input signal is based on a resistor divider formed from three resistors R6, R24 and R9, enters chip IC1 at pin 1 and is filtered by a capacitor C16. The third control input signal is a DC feedback signal to chip IC1 and represents the DC level across the output of preconditioner 80.

The fourth control input signal represents current passing through transistor Q1 and is determined based on resistor R5 which monitors all currents to Q1. At the junction between a resistor R23 and a capacitor C15, which serves as a lowpass filter, the FOURTH control input signal is fed into pin 4 of chip IC1. Responsive to a combination of the first, THIRD and FOURTH control input signals, chip IC1 turns OFF transistor Q1.

Preconditioner control 50 also includes an integrated circuit IC3, three resistors R30, R31 and R35 and a pair of diodes D13 and D14 which together limit the peak amplitude of the DC voltage across capacitors C5' and C6' at the time ballast 20 is turned ON and during operation of ballast 20 before lamp ignition. This portion of preconditioner control 50 functions as a comparator which injects a DC offset current into pin 4 of IC1 when the voltage at pin 2 of IC1 drops below a threshold level.

Referring once again to FIG. 3, the rectified AC (i.e. pulsating DC) signal supplied to preconditioner 80 from diode bridge rectifier 30 is boosted in magnitude by choke L3 and diode D5 to charge capacitors C1, C5 and C6. In FIG. 3, capacitor C1 is separate from capacitors C5 and C6, capacitor C1 being a large electrolytic capacitor in the range of 5 to 100 microfarads. Capacitors C5 and C6 are high frequency bridge capacitors. Since capacitor C1 is in parallel with the series combination of capacitors C5 and C6, these three capacitors can be reconfigured as capacitors C5' and C6' as shown in FIG. 5.

Preconditioner 80 is an up-converter and boosts the rectified AC input voltage as follows. When transistor Q6 (which serves as a switch) is closed, choke L3 is short circuited to ground. Current flows through choke L3. Transistor Q1 is then opened (turned OFF). Choke L3 with transistor Q1 open transfers stored energy through diode D5 into capacitor C1 of FIG. 3 or capacitors Q5' and Q6' of FIG. 5. The amount of energy transferred to capacitor C1 of FIG. 3 or capacitor C5' and C6' of FIG. 5 is based on the time during which transistor Q1 is turned ON, that is, based on the frequency and duration of the driving signal supplied to the gate of transistor Q1 through resistor R4 by chip IC1. Asynchronous operation of transistor Q1 with respect to voltage $V_{LN}$ results.

Choke L3 operates in a discontinuous mode, that is, the current through choke L3 during each cycle is reduced to substantially zero before a new cycle is initiated. The frequency at which transistor Q1 is turned ON and OFF is varied by preconditioner control 50 so that the peak current through choke L3 is kept constant as set by resistor R5 (in FIG. 5). The DC voltage across capacitors C5', C6' (in FIG. 5) is kept constant as set by the feedback network of resistors R6, R24 and R9 and capacitor C16. Resistors R26 and R10 are connected to the input of choke L3 and provide a DC bias as the initial power supply for half bridge drive 70 and an integrated circuit chip IC2 and as the bias for chip IC3 through resistor R31. Chip IC2 of half bridge drive 70 is a CMOS 555 timer which can be turned ON with a very low DC current in the order of 1 milliamp supplied via resistors R26 and R10.

Once, the half-bridge inverter is operating, the low voltage (snubber) power supply for IC2 is provided to chip IC2 through a pair of capacitors C21 and C23, a pair of diodes D16 and D15 and a zener diode D11. Chip IC2 has a limited output drive capacity. To increase this capacity, a pair of transistors Q4 and Q5 are used to help drive both half-bridge drive 70 and level shifter 60. A square wave signal from chip IC2 via transistors Q4, Q5 is supplied through resistor R17 and diode D17 to the gate of transistor Q7. Diode D17 in parallel with resistor R17 operates as a fast turnoff diode for quick discharge at the gate of transistor Q7. Resistor R17 and the internal gate capacitance of transistor Q7 provide a delay for turning ON transistor Q7. A controlled turn ON and a quick turn OFF of transistor Q7 is therefore provided. The signal present at the emitters of transistors Q4 and Q5 is also used to drive transistor Q2 of level shifter 60.

Level shifter 60 operates as follows: When transistor Q7 is turned ON, capacitor C7 is connected to ground through transistor Q7. capacitor c7 is charged through resistor R11 and diode D6 from the low voltage power supply of chip IC2 (i.e. junction of zener diode D11 and capacitor C21). During the period of time that transistor Q7 is turned ON, capacitor C7 becomes fully charged to the low voltage power supply voltage. Concurrently, the gate of transistor Q6 has been pulled to ground potential by diode D7, resistors R14 and R15 and transistor Q2.

Transistor Q2 can be viewed as being in parallel with transistor Q7 so that transistors Q2 and Q7 are turned ON and turned OFF at the same time. When transistors Q2 and Q7 are turned OFF, the stored charge of transistor Q7 is applied at the junction of the source of transistor Q6 and the drain of transistor Q7. This junction is now charged to the low voltage power supply. Resistor R12 quickly turns on the base of transistor Q3 so that charge can be transferred from capacitor C7 into the gate capacitance of transistor Q6 through transistor Q3 and resistor R13. Transistor Q6 is turned 0N permitting current to flow therethrough.

Transistors Q6 and Q7 have internal diodes (not shown). These diodes, which can either be internal or external to the transistors, permit inductive currents to flow through transistors Q6 and Q7 at the initial turn ON and turn OFF of transistors Q6 and Q7.

Preferably, capacitors C5' and C6' are electrolytic capacitors having a pair of discharge resistors R5' and R6' in parallel, respectively. Transformer T1 is a leakage transformer, that is, having a leakage inductor of inductance $L_M$ which serves as the ballast for lamp load LL (i.e. to limit steady state current flow through the lamp load). Alternatively, when transformer T1 has little or no leakage inductance an external inductor of inductance $L_M$ is required for ballast purposes. Three windings $T_{H1}$, $T_{H2}$ and $T_{H3}$ provide the necessary current for heating the filaments of lamps LL1 and LL2 during ignition and steady state operation. In series with windings $T_{H1}$, $T_{H2}$ and $T_{H3}$ are inductors L4, L5 and L6, respectively, for limiting the current in the lamp filaments.

Transformer T1 has a main secondary winding $T_M$. A resonant capacitor C10 is in series with inductor $L_7$ and reflects back to the primary winding of transformer T1 as a series LC combination across the half-bridge inverter. A capacitor C11 serves as a DC blocking capacitor to prevent rectification if this should occur within the lamp load. In parallel with capacitor C11 is a resistor R34 for discharge of capacitor C11 should rectification occur. Blocking capacitor C11 has substantially no ballast function (i.e. to limit steady state current flow through the lamp load) and typically has a minimal voltage drop in the order of several volts. A capacitor C12 serves as a bypass capacitor for lamp LL2 and is used during lamp starting as part of a normal lamp sequence starting scheme.

As now can be readily appreciated, by maintaining the fundamental sinusoidal frequency $f_1$ well below resonant frequency $f_0$ of the series L-C output circuit, the undesirable and unsafe high voltages and current levels produced in conventional ballast circuits during pre-ignition of lamp load LL are avoided. More particularly, by choosing the values of inductor $L_7$ and capacitor $C_{10}$ such that their resonant frequency f0 is defined by eq. 8, the voltage level across inductor $L_7$ and capacitor $C_{10}$ and current flow therethrough will be maintained at levels far below conventional ballast output circuits during pre-ignition of lamp load LL.

By not requiring the combination of inductor $L_7$ and capacitor $C_{10}$ to be operated at its resonant frequency $f_0$ during pre-ignition of lamp load LL, the value of capacitor C10 can be significantly reduced. For example, conventional values for capacitor $C_{10}$ range from about a nominal value of 6.8 nanofarads to about a nominal value of 9.2 nanofarads. In accordance with the invention, however, capacitor $C_{10}$ can be reduced in value by approximately one-fourth to one-sixth. (e.g. to approximately 1.2 nanofarads) Consequently, a far smaller, less expensive capacitor $C_{10}$ is required reducing the manufacturing cost and space requirements of the ballast output circuit.

In a conventional ballast output circuit the current flowing through capacitor $C_{10}$ after lamp ignition is approximately the same as the current flowing through lamp load LL. In accordance with the invention, however, the reduced value of capacitor $C_{10}$ results in substantially all current flowing through lamp load LL with relatively little current flowing through capacitor $C_2$. Power requirements for the ballast circuit can be reduced and/or less costly wiring (higher resistance) can be used in the series connected L-C ballast output circuit while maintaining the same power requirements as in a conventional ballast output circuit. In other words, a less costly and/or more efficient ballast with smaller space requirements is provided by the present invention.

Preferably, resonant frequency $f_0$ should range from approximately 2.3 to 2.6 times fundamental frequency $f_1$ of the square wave generated by the square wave generator. Consequently, stray inductances and the like which may be difficult to account for will not increase the overall inductance. Resonant frequency $f_0$ will not approach third harmonic frequency $3f_1$. Unsafe operation (i.e., resonant operation of the series L-C output circuit) of ballast circuit 20 is prevented.

Generally, in calculating the inductance of inductor $L_7$ for determining resonant frequency $f_0$, the leakage inductance of transformer $T_1$ or inductance of the discrete choke used for inductor $L_7$ is far greater than the stray inductance or other inductances within ballast circuit 20. Therefore, as a first order approximation, the inductance of inductor $L_7$ can be used without taking into account stray inductances and the like in determining the resonant frequency $f_0$. For a tightly wound transformer $T_1$ in which very little or an insufficient amount of leakage inductance exists, a discrete inductor will be required to serve as the ballasting element for lamp load LL (i.e., to control the lamp current $I_{LAMP}$) .

As now can be readily appreciated, the generated voltage (i.e. voltage E of FIG. 1 and voltage $V_{A-B}$ of FIG. 4(*a*)) is at a frequency which is far less than the resonant frequency of the series connected L-C circuit and therefore provides safe open circuit (pre-ignition) voltages and current levels. The frequency of this generated signal need not be changed following pre-ignition since it is never at or near resonant frequency $f_0$ of the series connected L-C circuit. Feedback circuitry for sensing ignition of lamp load LL for switching to a different steady-state lamp operating frequency need not be provided. By eliminated the need to operate at resonant frequency $f_0$ of the series L-C circuit during pre-ignition of lamp load LL, the value and resulting size of the capacitor for the series connected L-C circuit can be far smaller than normally used in a conventional series connected L-C circuit.

It will thus be seen that the objects set forth above and those made apparent from the preceding description are efficiently attained and, since certain changes can be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A ballast circuit for generating a driving signal sufficient to ignite a lamp load, comprising:

inductor means adapted to exhibit the properties of inductance;

a capacitor for providing the driving signal and serially connected to said inductor means so as to form a serially connected inductor-capacitor circuit; and generating means for applying a generated signal to the circuit, said generated signal having at least a fundamental frequency;

wherein the inductor means and capacitor are characterized by a single resonant frequency which is at least $\sqrt{5}$ times but less than three times greater than the fundamental frequency.

2. The ballast circuit of claim 1, wherein the generated signal is a train of square waves.

3. The ballast circuit of claim 1, wherein the generating means includes a half-bridge inverter.

4. The ballast circuit of claim 2, wherein the generating means includes a half-bridge inverter.

5. The ballast circuit of claim 1, wherein the lamp load following ignition enters into a steady-state mode of operation in which current therethrough is maintained at a substantially constant level, said generating means during said steady-state mode further operable for continuing to apply said generated signal at the same fundamental frequency to the serially connected inductor means and capacitor.

6. The ballast circuit of claim 1, wherein said lamp load is connected across the capacitor.

7. The ballast circuit of claim 2, wherein the lamp load following ignition enters into a steady-state mode of operation in which current therethrough is maintained at a substantially constant level, said generating means during said steady-state mode further operable for continuing to apply said generated signal at the same fundamental frequency to the serially connected inductor means and capacitor.

8. The ballast circuit of claim 3, wherein the lamp load following ignition enters into a steady-state mode of operation in which current therethrough is maintained at a substantially constant level, said generating means during said steady-state mode further operable for continuing to apply said generated signal at the same fundamental frequency to the serially connected inductor means and capacitor.

9. The ballast circuit of claim 5, wherein said lamp load is connected across the capacitor.

10. The ballast circuit of claim 6, wherein the lamp load includes at least one fluorescent lamp.

11. A method for generating a driving signal sufficient to ignite a lamp load, comprising the steps of:

supplying a generated signal having at least a fundamental frequency;

applying said generated signal to a series connected inductor and capacitor; and producing the driving signal across the capacitor;

wherein said inductor and capacitor are characterized by a single resonant frequency which is at least $\sqrt{5}$ greater than but less than a third harmonic of the fundamental frequency.

12. The method of claim 11, wherein the generated signal is a train of square waves.

13. The method of claim 11, wherein the generated signal is produced from a half-bridge inverter.

14. The method of claim 11, wherein the lamp load following ignition enters into a steady-state mode of operation in which current therethrough is maintained at a substantially constant level and further including continuing to produce substantially the same generated signal during the steady-state mode.

15. The method of claim 11, wherein the lamp load following ignition enters into a steady-state mode of operation in which current therethrough is maintained at a substantially constant level and further including continuing to produce substantially the same generated signal during the steady-state mode.

16. The method of claim 12, wherein the lamp load following ignition enters into a steady-state mode of operation in which current therethrough is maintained at a substantially constant level and further including continuing to produce substantially the same generated signal during the steady-state mode.

17. The method of claim 12, wherein the generated signal is produced from a half-bridge inverter.

18. The method of claim 12, wherein the lamp load following ignition enters into a steady-state mode of operation in which current therethrough is maintained at a substantially constant level and further including continuing to produce substantially the same generated signal during the steady-state mode.

19. The method of claim 13, wherein the lamp load following ignition enters into a steady-state mode of operation in which current therethrough is maintained at a substantially constant level and further including continuing to produce substantially the same generated signal during the steady-state mode.

20. The method of claim 13, wherein the lamp load following ignition enters into a steady-state mode of operation in which current therethrough is maintained at a substantially constant level and further including continuing to produce substantially the same generated signal during the steady-state mode.

21. The method of claim 17, wherein the lamp load following ignition enters into a steady-state mode of operation in which current therethrough is maintained at a substantially constant level and further including continuing to produce substantially the same generated signal during the steady-state mode.

22. The method of claim 17, wherein the lamp load following ignition enters into a steady-state mode of operation in which current therethrough is maintained at a substantially constant level and further including continuing to produce substantially the same generated signal during the steady-state mode.

23. A ballast circuit for generating a driving signal sufficient to ignite a lamp load, comprising:

an inductor and a capacitor connected in series, the lamp load being connected in parallel with the capacitor; and a half-bridge inverter for applying a train of square waves to the series connected inductor and capacitor, each square wave including at least a fundamental frequency and a third harmonic of the fundamental frequency;

wherein the inductor and capacitor are characterized by a single resonant frequency which is at least $\sqrt{5}$ times greater than the fundamental frequency and less than the third harmonic.

24. A solid-state ballast circuit for starting and steady-state operating a gaseous discharge lamp, comprising:

a) a series LC circuit comprising an inductance and a capacitance forming a first series resonant circuit at a single resonant first frequency, said lamp being coupled across said capacitance, b) a source of AC voltage at a fundamental second frequency connected across said series LC circuit to drive said LC circuit with a voltage at said second frequency, c) said resonant first frequency being equal to at least $\sqrt{5}$ times but less than a third has more of the fundamental second frequency, d) said ballast circuit operating with a voltage at a single frequency equal to said second frequency during both starting and steady-state operating of said lamp.

25. A solid-state ballast circuit for starting and steady-state operating a gaseous discharge lamp, comprising:

a) a series LC circuit comprising an inductance and a capacitance forming a first series resonant circuit at a single resonant first frequency, said lamp being coupled across said capacitance, b) a source of AC voltage at a fundamental second frequency connected across said series LC circuit to drive said LC circuit with a voltage at said second frequency, c) said resonant first frequency being equal to at least $\sqrt{5}$ but less than 3 times the fundamental second frequency, d) said ballast circuit operating with a voltage at a single frequency equal to said second frequency during both starting and steady-state operating of said lamp.

26. A solid-state ballast having ballast terminals for starting and steady-state operating a gaseous discharge lamp connected to said ballast terminals for receiving an operating voltage, said solid-state ballast comprising:

a) a series LC circuit comprising an inductance and a capacitance forming a series resonant first circuit at a single resonant first frequency, said ballast terminals being coupled across said capacitance for connection to said lamp terminals, b) a source of AC voltage at a fundamental second frequency connected across said series LC circuit to drive said LC circuit with a current at said second frequency, c) said resonant first frequency being equal to at least $\sqrt{5}$ times but less than a third harmonic of the fundamental second frequency, d) said solid-state ballast producing at its ballast terminals during steady-state operating a substantially sinusoidal lamp current at said second frequency.

27. A circuit comprising:

A) a gaseous discharge lamp having terminals for receiving an operating voltage, B) a solid-state ballast for starting and operating said lamp, said solid-state ballast comprising:

a) a series LC circuit comprising an inductance and a capacitance forming a series resonant first circuit at a single resonant first frequency, said lamp terminals being coupled across said capacitance, b) a source of AC voltage at a fundamental second frequency connected across said series LC circuit to drive said LC circuit with a current at said second frequency, c) said resonant first frequency being equal to at least $\sqrt{5}$ times but less than a third harmonic of the fundamental second frequency, C) said lamp terminals during steady-state operating receiving a substantially sinusoidal lamp current at said second frequency.

* * * * *